United States Patent [19]

Tomita

[11] 4,116,184

[45] Sep. 26, 1978

[54] APPARATUS FOR TREATING EVAPORATED FUEL GAS

[75] Inventor: Kazuo Tomita, Shizuoka, Japan

[73] Assignee: Toyota Jidosha Kogyo Kabushiki Kaisha, Japan

[21] Appl. No.: 757,013

[22] Filed: Jan. 5, 1977

[30] Foreign Application Priority Data

Oct. 4, 1976 [JP] Japan ..... 51-119115

[51] Int. Cl.[2] ..... F02M 23/12

[52] U.S. Cl. ..... 123/136; 123/119 D

[58] Field of Search ..... 123/136, 119 EC, 119 D; 220/85 VR, 85 VS

[56] References Cited

U.S. PATENT DOCUMENTS

| | | | |
|---|---|---|---|
| 2,917,201 | 12/1959 | Draper | 220/88 R |
| 3,001,519 | 9/1961 | Dietrich et al. | 123/136 |
| 3,518,977 | 7/1970 | Smith | 123/136 |
| 3,645,244 | 2/1972 | Seyfarth | 123/136 |
| 3,690,307 | 9/1972 | O'Neill | 123/136 |
| 3,752,134 | 8/1973 | Hollis, Jr. | 123/136 |
| 3,872,848 | 3/1975 | King | 123/136 |
| 3,935,850 | 2/1976 | King | 123/136 |
| 4,003,358 | 1/1977 | Tatsutomi et al. | 123/136 |
| 4,013,054 | 3/1977 | Balsley et al. | 123/136 |

*Primary Examiner*—Charles J. Myhre
*Assistant Examiner*—Andrew M. Dolinar
*Attorney, Agent, or Firm*—Koda and Androlia

[57] ABSTRACT

An apparatus for treating evaporated fuel gas from a fuel tank of a motor vehicle having an internal combustion engine. The fuel treating apparatus includes a means for sensing the amount of fuel gas vapors in the fuel tank, a means for drawing the fuel vapors into the intake of the engine and a means for varying the air/fuel ratio in the intake of the engine in response to the amount of fuel gas vapors sensed in the fuel tank by the sensing means whereby a rich air/fuel mixture in the intake of the engine is prevented.

4 Claims, 1 Drawing Figure

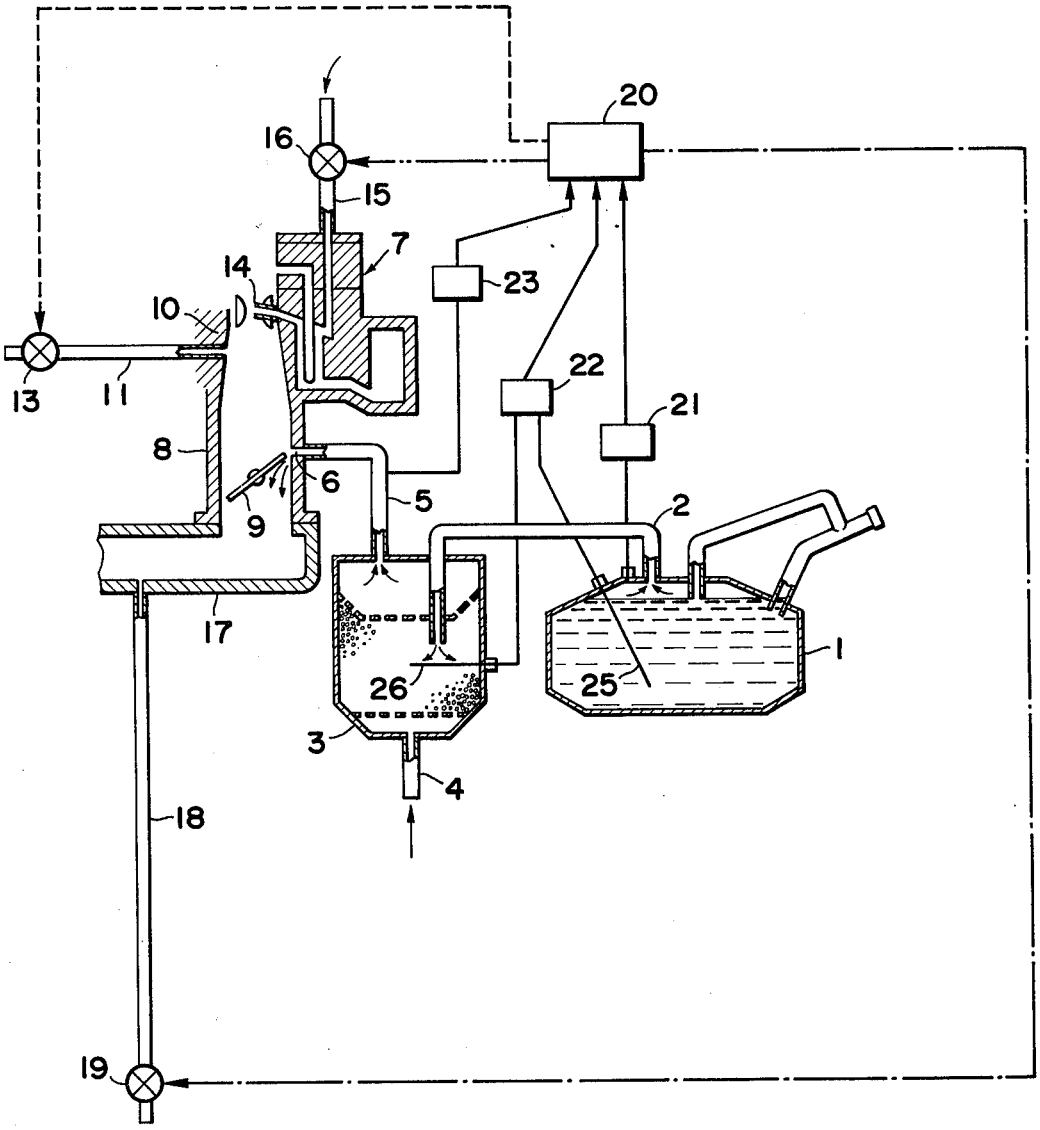
20
16
15
7
14
23
10
22
13
11
21
8
6
5
2
9
17
1
26
25
3
4
18
19

APPARATUS FOR TREATING EVAPORATED FUEL GAS

BACKGROUND OF THE INVENTION

1. Field of Invention

This invention relates to fuel systems for internal combustion engines and more particularly to means for reducing the amount of evaporated fuel gas which enters the atmosphere.

2. Prior Art

According to conventional type apparauses for treating evaporated fuel gas, evaporated gases from a gas tank or float chamber of a carburetor are absorbed into a charcoal canister containing activated charcoal or the like. The gas vapors are then drawn out of the canister into the intake system of the engine by means of the negative pressure in a carburetor or an intake manifold of the engine. However, these prior art apparatuses include no means for adjusting the air/fuel ratio of the gas mixture provided to the engine. Therefore, there is a major shortcoming in that the fuel/air ratio becomes too rich under conditions when the temperature of the fuel is high and more fuel vapor exists than usual. As a result thereof, the condition of the exhaust, the gas mileage and the running efficiency of the motor vehicle deteriorates.

SUMMARY OF THE INVENTION

Accordingly, it is a general object of the present invention to overcome the shortcomings of the prior art.

It is another object of the present invention to provide a means for treating the evaporated fuel gas which maintains the fuel/air ratio of the gas mixture into the engine at an optimum ratio regardless of the condition of the fuel contained in the fuel tank.

In keeping with the principles of the present invention, the objects are accomplished with a unique apparatus for treating evaporated fuel gas from a fuel tank or the like of a motor vehicle having an internal combustion engine. The fuel treating apparatus includes a means for sensing the amount of fuel gas vapors in the fuel tank, a means for drawing the fuel vapors into the intake of the engine and a means for varying the air/fuel ratio in the intake of the engine in response to the amount of fuel gas vapors sensed in the fuel tank by the sensing means whereby a rich air/fuel mixture in the intake of the engine is prevented.

In the preferred embodiment, the amount of fuel vapors present in the fuel tank is sensed directly and indirectly by a plurality of sensors. In particular, the sensors monitor the temperature of the gas in the tank and the pressure of and amount of fuel gas vapors contained in the means for drawing the fuel vapors into the intake of the engine.

BRIEF DESCRIPTION OF THE DRAWINGS

The above mentioned and other features and objects of the present invention will become more apparent by reference to the following description taken in conjunction with the accompanying drawings, in which the FIGURE is a diagram of a fuel gas vapor treatment apparatus in accordance with the teachings of the present invention.

DESCRIPTION OF THE PREFERRED EMBODIMENT

Referring to FIGURE, shown therein is an apparatus for treatment of fuel gas vapors in accordance with the teachings of the present invention. In FIGURE the apparatus includes a fuel tank 1 which is vented to a charcoal canister 3 through an evaporated gas conveying pipe 2. The charcoal canister 3 is provided with an evaporated gas absorbing material such as activated charcoal or the like therein. The bottom portion of the canister 3 is provided with a purged air intake pipe 4 to introduce air into the canister 3. The top portion of the canister 3 is coupled to a purge port 6 which opens into the intake passage 8 of the carburetor 7 below the throttle valve 9 of the carburetor 7.

The carburetor 7 is provided with a ventilating opening 10 which is coupled to one end of a supplemental air supplying pipe 11. The other end of pipe 11 is open to the atmosphere via valve 13.

The main fuel nozzle 14 of the carburetor 7 is also coupled to one end of a supplemental air supplying passage 15. The other end of supplemental air supplying passage 15 is coupled to the atmosphere via a valve 16. Intake manifold 17 is also coupled to one end of a second supplemental air supplying pipe 18 at a point below the throttle valve 9 of the carburetor 7. The other end of the second pipe 18 is open to the atmosphere via a valve 19.

The valves 13, 16 and 19 must be controllable valves such as electromagnetic types. Coupled to each one of the valves 13, 16 and 19 is a controller 20. Controller 20 generates a control signal to valves 13, 16 and 19 so as to vary the air/fuel ratio of the mixture in the intake of the engine. The controller 20 receives signals from a pressure sensor 21 coupled to the fuel tank 1, a temperature signal amplifier 22 which senses the temperature of the fuel in the fuel tank and the canister 3 via sensor 25 and 26 and a hydrocarbon density detector 23 provided in purge pipe 5.

The pressure sensor 21 can be any pressure sensor so long as it is designed to detect the pressure of the gas vapors in the fuel tank 1. The temperature signal amplifier 22 is of conventional design and is used to amplify the temperature signals from the sensor 25 in the fuel tank 1 and the sensor 26 in the canister 3. The hydrocarbon density detector 23 is also of conventional design and is used to detect the hydrocarbon density of the fuel gas vapors in the purge pipe 5. The controller 20 is also of conventional design and could be designed by the routineer in the art.

In operation, when the fuel in the fuel tank 1 is warm the fuel gas evaporates to a certain degree. The evaporated fuel gas is transmitted through the evaporated gas conveying pipe 2 to the charcoal canister 3 where gas is absorbed by the activated charcoal. While running the engine, the gas absorbed by the activated charcoal will be drawn out of the canister 3 as a result of the lower pressure in the purge pipe 5 coupled to the carburetor 7 via purge port 6. However, under conditions which cause excessive gas vapors, the fuel/air ratio of the fuel mixture supplied to the engine is too rich thereby deteriorating the exhaust gas composition, the gas mileage and the driving efficiency.

One condition which cause excessive evaporated gas is a temperature increase of the fuel gas. A temperature increase will be followed by an increase in the pressure in the fuel tank 1, a rise in the temperature in the charcoal canister 3 and a rise in the hydrocarbon density in the purge pipe 5. Therefore, by monitoring one or more of the above by means of a pressure transformer 21, temperature sensors 25 and 26 and hydrocarbon density detector 23, the controller 20 opens or closes the valves 13, 16 and 19 so that an increased amount of air is introduced through the valve 16 into the main air bleed to the carburetor 7, through the valve 13 to the carburetor, and through the valve 19 to the intake manifold 17 to thereby maintain an appropriate fuel/air ratio. Controller 20 is responsive to sensors 21, 25, 26 and 23 such that it will generate an actuating signal to valves 13, 16 and 19, which may be electromagnetically actuated valves. When the amount of evaporated fuel gas increases, the amount of air permitted by valves 13, 16 and 19 into the intake portion of the engine increases. The amount of intake air increases by allowing a greater quantity of air through the air intake passage of the carburetor, the intake passage of the manifold or the main air bleed passage of the carburetor. In other words, a positive response received by the sensors is interpreted by controller 20 to cause the controllable means or valves to increase the intake amount of air into the engine. Conventional circuitry, well known to the art, is used to achieve this purpose with respect to the combination of elements disclosed herein.

It should be apparent to one skilled in the art that all of the conditions which are sensed need not all be sensed and that other conditions could be sensed without departing from the spirit and scope of the invention.

In all cases it is understood that the above described embodiment is merely illustrative of but one of the many possible specific embodiments which can represent application of the principles of the present invention. Numerous and varied other arrangements can be readily devised in accordance with these principles by those skilled in the art without departing from the spirit and scope of the invention.

I claim:

1. An apparatus for treating evaporated fuel gas in a motor vehicle having a closed fuel tank vented to an intake portion of an engine in said motor vehicle via a pipe and charcoal canister, said apparatus comprising:

a means for sensing a plurality of parameters indicative of the amount of evaporated fuel gas at a plurality of locations;

a controllable means for increasing the amount of air into said intake portion of said engine through at least one of three passages, an air intake passage of a carburetor, an intake manifold passage and a main air bleed passage of said carburetor; and a control means responsive to said sensing means for actuating said controllable means such that when the amount of evaporated fuel gas increases at said plurality of locations, the amount of air in said intake portion is increased thereby maintaining a proper air-fuel ratio.

2. An apparatus according to claim 1 wherein said sensing means comprises:

a pressure sensor provided in said fuel tank;

a temperature sensor in said fuel tank;

a temperature sensor provided in said charcoal canister; and a hydrocarbon density sensor provided in said pipe.

3. An apparatus according to claim 1 wherein said sensing means includes a hydrocarbon density sensor in said pipe.

4. An apparatus for treating evaporated fuel gas in a motor vehicle having a closed fuel tank vented to an intake portion of an engine in said motor vehicle via a pipe and charcoal canister, said apparatus comprising:

a means for sensing the amount of evaporated fuel gas including a pressure sensor provided in said fuel tank, a temperature sensor in said fuel tank, a temperature sensor provided in said charcoal canister, and a hydrocarbon density sensor provided in said pipe;

a controllable means for increasing the amount of air into said intake portion of said engine through at least one of three passages, an air intake passage of a carburetor, an intake manifold passage and a main air bleed passage of said carburetor; and a control means responsive to said sensing means for actuating said controllable means to increase the amount of air in said intake portion as said amount of evaporated fuel gas increases thereby maintaining a proper air-fuel ratio.

* * * * *